US012144475B2

(12) United States Patent
Bian

(10) Patent No.: US 12,144,475 B2
(45) Date of Patent: Nov. 19, 2024

(54) SURFACE CLEANING APPARATUS

(71) Applicant: SUZHOU EUP ELECTRIC CO. LTD., Suzhou (CN)

(72) Inventor: Zhuang Bian, Suzhou (CN)

(73) Assignee: SUZHOU EUP ELECTRIC CO. LTD., Suzhou (CN)

( * ) Notice: Subject to any disclaimer, the term of this patent is extended or adjusted under 35 U.S.C. 154(b) by 0 days.

(21) Appl. No.: 18/214,869

(22) Filed: Jun. 27, 2023

(65) Prior Publication Data

US 2023/0337887 A1 Oct. 26, 2023

Related U.S. Application Data

(62) Division of application No. 17/033,543, filed on Sep. 25, 2020, now Pat. No. 11,723,506.

(30) Foreign Application Priority Data

Jun. 18, 2020 (CN) ..... 202010559797.4
Jul. 22, 2020 (CN) ..... 202010709830.7

(51) Int. Cl.
*A47L 11/40* (2006.01)
*A47L 9/04* (2006.01)
*A47L 11/30* (2006.01)

(52) U.S. Cl.
CPC ..... *A47L 11/4086* (2013.01); *A47L 9/0477* (2013.01); *A47L 11/302* (2013.01); *A47L 11/4083* (2013.01); *A47L 11/4088* (2013.01)

(58) Field of Classification Search
CPC .... A47L 11/34; A47L 11/4086; A47L 13/225; A47L 9/0411; A47L 9/0483
See application file for complete search history.

(56) References Cited

U.S. PATENT DOCUMENTS 4,369,544 A 1/1983 Parisi ..... A47L 11/4047 15/320
4,696,074 A 9/1987 Cavalli ..... F22B 1/28 15/322
5,613,271 A * 3/1997 Thomas ..... A47L 11/4086 15/322

(Continued)

FOREIGN PATENT DOCUMENTS

CN 1771879 A 7/1930
CN 102240190 A 11/2011

(Continued)

*Primary Examiner* — Andrew A Horton
(74) *Attorney, Agent, or Firm* — SZDC Law PC

(57) ABSTRACT

The invention discloses a surface cleaning apparatus comprising: a source of suction; the cleaning head comprises a housing and a cleaning roller. The cleaning head is provided with a cleaning liquid output for applying the cleaning liquid and at least one steam output for applying steam relative to the surface to be cleaned by the rolling brush; wherein the steam outlet steam outlet is arranged at the lower portion of the housing and configured to heat the surface by overflowing the steam to the surface to accelerate the evaporation of residual cleaning liquid on the surface. The apparatus introduces steam for heating the surface, thereby it can accelerate evaporation surface on the residual cleaning solution and shorten user latency.

20 Claims, 9 Drawing Sheets

(56) References Cited

U.S. PATENT DOCUMENTS

| | | | | |
|---|---|---|---|---|
| 7,836,543 | B2 | 11/2010 | Field | B08B 3/024 204/205 |
| 7,917,991 | B2 | 4/2011 | Chung et al. | |
| 8,752,236 | B2 | 6/2014 | Oh et al. | |
| 9,526,387 | B1 * | 12/2016 | Li | A61L 2/10 |
| 10,327,615 | B2 | 6/2019 | Huang et al. | |
| 10,398,274 | B2 | 9/2019 | Kasper | |
| 2015/0342435 | A1 * | 12/2015 | Gordon | A47L 9/0472 15/320 |
| 2019/0290087 | A1 | 9/2019 | Conrad et al. | |
| 2019/0380554 | A1 | 12/2019 | Kasper | |
| 2020/0268225 | A1 | 8/2020 | Ashbaugh et al. | |

FOREIGN PATENT DOCUMENTS

| | | | |
|---|---|---|---|
| CN | 204931569 | U | 1/2016 |
| CN | 207152545 | U | 3/2018 |
| CN | 207306612 | U | 5/2018 |
| CN | 208709740 | U | 4/2019 |
| CN | 110025269 | A | 7/2019 |
| CN | 209220154 | U | 8/2019 |
| CN | 110507241 | A | 11/2019 |
| CN | 110811413 | A | 2/2020 |
| CN | 210643937 | U | 6/2020 |
| GB | 2509251 | A | 6/2014 |
| KR | 101609444 | B1 | 4/2016 |
| KR | 101787469 | B1 | 10/2017 |
| KR | 102128194 | B1 | 7/2020 |

* cited by examiner

SURFACE CLEANING APPARATUS

REFERENCE TO RELATED APPLICATIONS

This application is a Divisional Application of U.S. Ser. No. 17/033,543, filed on Sep. 25, 2020, which claims the priority of Chinese Patent Application No. CN 202010559797.4, filed on Jun. 18, 2020 and Chinese Patent Application No. CN 202010709830.7, filed on Jul. 22, 2020, the entire contents of which are incorporated herein by reference.

TECHNICAL FIELD

The present invention relates to a surface cleaning apparatus, and in particular to a wet surface cleaning apparatus for cleaning by applying a cleaning liquid and steam to a surface to be cleaned and recovering the dirty liquid after cleaning.

BACKGROUND OF THE INVENTION

It is well known that wet floor cleaning apparatuses are known, for example, in the form of a floor cleaning apparatus or a floor scrubbing apparatus. Some of the apparatuses use one or more cleaning rollers rotating about one or more horizontal axes as cleaning tools; some use a pair of scrubbing trays that rotates about a vertical axis perpendicular to a horizontal plane as cleaning tools; and some use a pair of scrubbing sheets that is configured to reciprocally move in a front-rear direction or a left-right direction as cleaning tools. These cleaning tools contact with floors to be cleaned and clean them with the aid of a cleaning liquid. The cleaning liquid is stored in a cleaning liquid supply container and applied to the floors during the cleaning process.

Subsequently, some apparatuses suck the applied cleaning liquid together with cleaned dirt (which may include dirt, dust, stain, mud, hair and other debris) from the floors under the action of the cleaning roller and a suction unit and convey them to a dirty liquid storage container; and some apparatuses only recover the dirt on the surface to be cleaned. This recovery may be performed by using a suction source for suction, or the dirty liquid and/or dirt may be recovered in a manner similar to that of a sweeper.

Most of the aforementioned floor cleaning apparatuses have the following problems: during the cleaning process, the liquid applied to the floor is not recovered completely; there is residual dirty liquid on the cleaned floor; and a user has to wait for a long period of time (about 15 minutes) before he or she walks on the cleaned floor so that the dirty liquid on the floor may evaporate naturally.

In order to solve the aforementioned problems, in the prior art, it is proposed to add an absorbent cloth or a dry cleaning roller to the back side of the cleaning roller. Such a solution may solve the problem of the residual dirty liquid on the floor to a certain extent but, at the same time, bring another problem: after the absorbent cloth or the dry cleaning roller is used, the user has to manually disassemble and clean or dry it, which increases the workload of the user and leads to poor user experience.

Therefore, although great progress has been in all aspects of the wet surface cleaning apparatus, consumers still expect to improve the surface cleaning apparatus, so that the time spent in waiting for the surface to dry after the wet cleaning is completed is shortened and not too much or no excessive workload is increased, thereby improving user experience.

BRIEF SUMMARY OF THE INVENTION

In view of the above technical problems, the present invention is intended to provide a wet surface cleaning apparatus which can clean a surface with a cleaning liquid and has the advantage that the cleaned surface can dry quickly, by improving the aforementioned surface cleaning apparatus.

In one aspect, the present invention provides a surface cleaning apparatus, comprising a suction source, a cleaning head adapted to move along a surface to be cleaned the head including a housing and a cleaning roller, a cleaning liquid supply tank adapted to store cleaning liquid, a steam generator in fluid communication with the supply tank and configured to heat liquid to generate steam, a first fluid delivery unit including at least one cleaning liquid outlet for applying the cleaning liquid in the cleaning liquid supply tank to the cleaning roller and/or the surface, a second fluid delivery unit including at least one steam outlet for applying the steam generated by the steam generator to the surface, and a dirty liquid recovery tank configured to accept dirty liquid and dirt, wherein the at least one steam outlet is arranged at a lower portion of the housing and configured to heat the surface by overflowing the steam to the surface to accelerate the evaporation of residual cleaning liquid on the surface.

The steam is introduced on the basis of wet cleaning with the cleaning liquid in the surface cleaning apparatus, and the surface is heated by the steam. Thus, the residual liquid on the surface may be evaporated more quickly after the surface is heated to achieve "quick drying", thereby shortening the time for the user to wait for the surface to dry. Moreover, as the temperature of the steam is high, it may not only increase the temperature of the surface when it contacts with the surface, but also sterilize the surface with high temperature, thereby further cleaning the surface.

The at least one steam outlet is preferably configured to spray the steam directly to the surface to be cleaned.

The least a part of the at least one steam outlet is preferably positioned behind the opening to enable the surface cleaning apparatus to heat a surface cleaned by the cleaning roller with the steam overflowing from the at least one steam outlet.

The cleaning head preferably includes a flexible partition arranged between the at least one steam outlet and the opening.

The cleaning head preferably includes a rear suction mouth provided at a rear portion of the housing, the rear suction mouth is positioned behind the at least one steam outlet, and the rear suction mouth is configured to be in fluid communication with the suction source. The cleaning head preferably includes a flexible flat suction nozzle arranged at the lower portion of the housing, wherein the flexible flat suction nozzle comprises a pair of flexible scraper lips arranged relatively front and back to each other, and the rear suction mouth is formed at the flexible flat suction nozzle; and at least one of the flexible scraper lips interferes with the surface to be cleaned when the cleaning head moves along the surface.

The cleaning head preferably includes a flexible liquid-scraping strip positioned behind the steam outlet, and the strip interferes with the surface to be cleaned when the cleaning head moves along the surface to be cleaned.

The at least one steam outlet is preferably plural in number. The cleaning head preferably includes a steam diffuser for diffusing the steam generated by the steam generator is provided at the lower portion of the housing, and the plurality of steam outlets are located at a lower portion of the steam diffuser. In a preferred embodiment, the steam diffuser comprises a steam bottom plate, and the plurality of steam outlets are arranged on a lower surface of the steam bottom plate.

The surface cleaning apparatus preferably comprises a body, the body having a handle at a upper part, and the cleaning head is in articulately connection to a lower part of the body. The dirty liquid recovery tank and the cleaning liquid supply tank are preferably both detachably positioned on the body.

The first fluid delivery unit preferably comprises a first pump arranged between the cleaning liquid supply tank and the at least one cleaning liquid outlet. The second fluid delivery unit preferably comprises a second pump arranged between the cleaning liquid supply tank and the steam generator.

The cleaning head preferably includes a cleaning cloth for scrubbing the surface to be cleaned is provided at the lower portion of the housing, the cleaning cloth is made of a steam-permeable material, and the steam outlet is configured to spray the steam to the cleaning cloth.

The cleaning head preferably includes a brush for scrubbing the surface to be cleaned is further provided at the lower portion of the housing.

At least part of the steam outlets are preferably arranged on the front side or left and right sides of the opening.

The first fluid delivery unit and the second fluid delivery unit are preferably each configured to be independently controllable for a user selectable delivery of the cleaning liquid or steam.

The first fluid delivery unit is preferably configured to output the cleaning liquid at a first flow rate or a second flow rate through the at least one cleaning liquid outlet.

In another aspect, the present invention provides another surface cleaning apparatus, comprising a cleaning head adapted to move along a surface to be cleaned including a housing and a scrubbing arrangement, the scrubbing arrangement including a scrubbing mechanism which is arranged on the housing and scrubs the surface by rubbing against the surface to be cleaned, and at least one driving motor connected to the scrubbing mechanism for driving the scrubbing mechanism to perform a scrubbing action; a cleaning liquid supply tank adapted to store cleaning liquid; a steam generator in fluid communication with the cleaning liquid supply tank configured to heat liquid to generate steam; a first fluid delivery unit comprising at least one cleaning liquid outlet for applying the cleaning liquid in the cleaning liquid supply tank to the scrubbing mechanism and/or the surface to be cleaned; a second fluid delivery unit comprising at least one steam outlet for applying the steam generated by the steam generator to the surface to be cleaned; and a dirty liquid recovery system used to remove the used cleaning liquid and dirt from the surface to be cleaned and store the used cleaning liquid and dirt, the dirty liquid recovery system including a dirty liquid recovery tank used to store dirty liquid and dirt, wherein the steam outlet is arranged at a lower portion of the housing and configured to heat the surface by overflowing steam to the surface to accelerate the evaporation of residual cleaning liquid on the surface.

The dirty liquid recovery system further preferably comprises a suction source and at least one suction nozzle provided on the cleaning head, wherein the suction source is in fluid communication with the dirty liquid recovery tank and is configured to generate working airflow through the at least one suction nozzle and into the dirty liquid recovery tank.

At least one suction nozzle is preferably arranged at a front end of the housing and is configured to extend toward the surface to be cleaned.

The scrubbing mechanism is preferably positioned behind the suction nozzle which is located at the front end of the housing.

The scrubbing mechanism preferably comprises at least one brushroll that is configured to rotate about an axis substantially parallel to the surface to be cleaned.

The scrubbing mechanism preferably comprises at least one cleaning tray mounted at the lower portion of the housing that is configured to rotate about an axis substantially perpendicular to the surface to be cleaned.

The surface cleaning apparatus according to claim 20, characterized in that the scrubbing mechanism comprises a pair of cleaning pads mounted at the lower portion of the housing that is configured to reciprocally move in a front-rear direction or a left-right direction, and the moving directions of the pair of cleaning pads are opposite all the time.

The at least one steam outlet is preferably configured to spray the steam directly to the surface to be cleaned.

At least a portion of the at least one steam outlet is preferably positioned behind the scrubbing mechanism such that the surface cleaning apparatus is capable of heating a surface scrubbed by the scrubbing mechanism with the steam overflowing from the steam outlet.

The cleaning head preferably comprises a flexible scraping strip arranged at the lower portion of the housing and positioned behind the at least one steam outlet, and the flexible scraping strip interferes with the surface to be cleaned when the cleaning head moves along the surface to be cleaned.

The steam diffuser for diffusing the steam generated by the steam generator is preferably provided at a lower portion of the cleaning head, the at least one steam outlet is plural in number, and the plurality of the steam outlets is arranged at a lower portion of the steam diffuser.

The surface cleaning apparatus preferably comprises a body having a handle at a upper part, and the cleaning head is in articulately connection to a lower portion of the body, the dirty liquid recovery tank and the cleaning liquid supply tank are detachably provided on the body.

The first fluid delivery unit preferably comprises a first pump arranged between the cleaning liquid supply tank and the at least one cleaning liquid outlet, and the second fluid delivery unit comprises a second pump arranged between the cleaning liquid supply tank and the steam generator.

Features described above in connection with the one aspect of the invention are equally applicable to the another aspect of the invention, and vice versa.

DETAILED DESCRIPTION OF THE INVENTION

Figure 1:
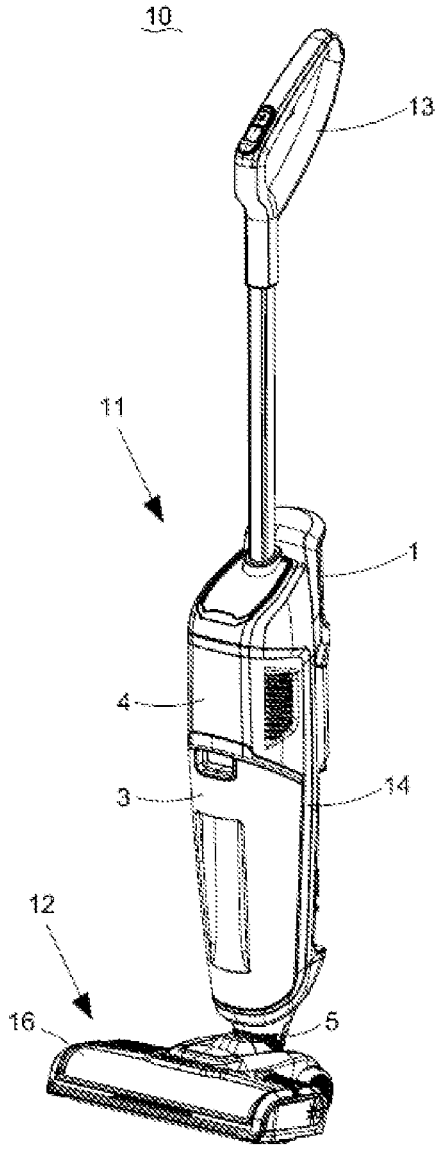
FIG. 1 is stereogram I of a surface cleaning apparatus according to a first embodiment of the present invention.

In order to describe in detail the technical content, structural features, achieved objectives and effects of the invention, the present invention will be described below in detail through embodiments in combination with accompanying drawings.

In the following, some embodiments of the present invention will be described in detail with reference to the accompanying drawings. It should be noted that when components in the drawings are designated by reference signs, even if the components are shown in different drawings, the same components should have the same reference signs wherever possible. In addition, in the description of the embodiments of the present disclosure, when it is determined that the detailed description of a well-known configuration or function will hinder the understanding of the embodiments of the present disclosure, the detailed description will be omitted.

In addition, words such as "first" and "second" may be used in the description of the embodiments of the present disclosure. Each word is only used to distinguish a corresponding component from other components, and is not intended to define the nature, order, or sequence of the corresponding component. It should be understood that when one component is "connected", "coupled" or "attached" to another component, the one component may be directly connected or attached to the another component, or the one component may be "connected", "coupled", or "attached" to the another component under the circumstance that a third component is arranged there between. For the purpose of description related to the drawings, positional relationships defined by the terms "upper", "lower", "left", "right", "front", "rear", "vertical", "horizontal", "internal", "external" and their derivatives are determined on the basis that a user stands on a surface to be cleaned and at a rear side of a surface cleaning apparatus. When being used, the surface cleaning apparatus of the present invention is pushed from back to front to move forwards or pulled from front to back to move backwards. As used herein, the term "rear side" refers to a position behind at least another component, but does not necessarily mean behind all other components, and the same applies to terms "front side" and "upper side"; and the term "lower portion" refers to a position at or near the bottom of a component. However, it should be understood that various alternative orientations may be used in the present invention unless the opposite orientation is explicitly indicated.

FIG. 1 shows a schematic diagram of a surface cleaning apparatus 10 according to a first embodiment of the present invention. The surface cleaning apparatus 10 is a vertical surface cleaning apparatus and includes a body 11 and a cleaning head 12. A lower portion of the body 11 is articulately connected to the cleaning head 12, and the body 11 can be movable between an upright parked position and a backwardly reclined using position relative to the cleaning head 12. During the cleaning process of the surface cleaning apparatus 10 along the surface to be cleaned, the cleaning head 12 is supported on the surface to be cleaned and guided by the body 11 to move along the surface to be cleaned. The apparatus can be held upright after being used.

Figure 2:
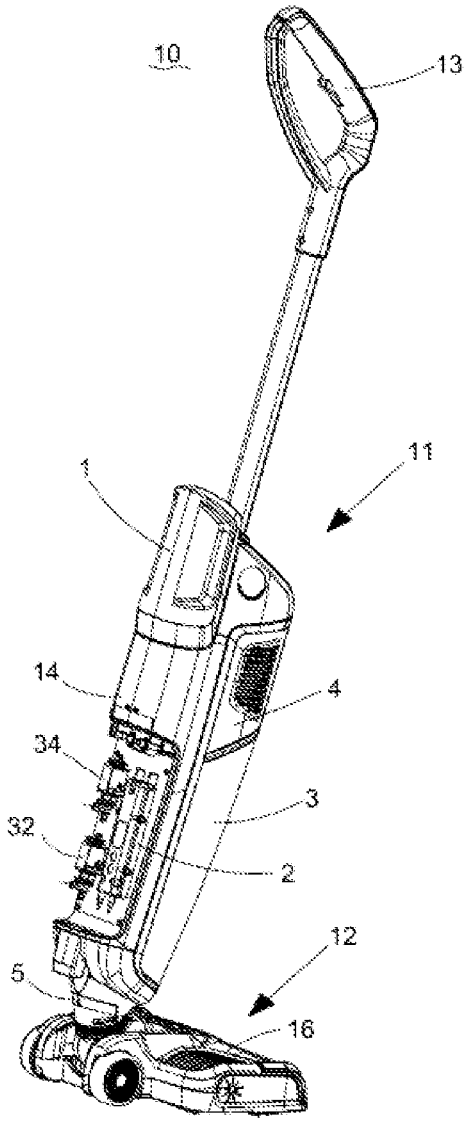
FIG. 2 is stereogram II of a surface cleaning apparatus according to the first embodiment of the present invention, wherein a portion of a rear of a housing is removed.

As shown in FIG. 2, a cleaning liquid supply system, a steam supply system, and a dirty liquid recovery system are arranged on the surface cleaning apparatus 10. The cleaning liquid supply system is used to store a supply of cleaning liquid and deliver the cleaning liquid to the cleaning head, and the cleaning liquid supply system includes a cleaning liquid supply tank 1 which is used to store the cleaning liquid. The steam supply system is used to heat and convert the cleaning liquid into high-temperature steam by a steam generator 2 and distribute the steam to the surface to be cleaned. The dirty liquid recovery system is used to remove the dirty liquid converted by the used cleaning liquid and dirt on the surface to be cleaned from the surface to be cleaned, and store the dirty liquid and dirt within a certain amount of time. The dirty liquid recovery system includes a dirty liquid recovery tank 3 for accepting dirty liquid and dirt for a certain period of time and a suction source 4.

A handle 13 for the user to hold is mounted at the top of the body 11. The operator may use the handle 13 to hold the surface cleaning apparatus 10 with one hand and then push the cleaning head 12 of the surface cleaning apparatus 10 to move frontwards and backwards on the surface to be cleaned when the surface cleaning apparatus is at the backwardly reclined using position. In other embodiments, the handle can also include a user interface assembly consisting of one or more operating elements. The elements can be such as but not limited to buttons, flip-flops, triggers, switches or the like, operably connected to systems in the apparatus to affect and control function. The operation of all controlled components in the surface cleaning apparatus can be controlled with these operating elements, for example, the surface cleaning apparatus is switched on or off for the cleaning operation, and the delivering of the cleaning fluid and the power of a suction apparatus are adjusted. In other embodiments, the user interface assembly can also be provided in other places of the surface cleaning apparatus, such as on a top wall or side wall of the body under the handle.

The body 11 further comprises a housing 14. The housing 14 is a main supporting part of the body 11 and mainly plays a role of accommodating or carrying the rest of the components on the body 11, such as carrying the suction source 4, the cleaning liquid supply tank 1, the steam generator 2, the dirty liquid recovery tank 3 and the like.

The suction source 4 is a suction force forming component of the dirty liquid recovery system and is used for generating a working airflow. The suction source 4 of the present embodiment comprises a suction motor which is arranged in the housing 14 and constituted by a motor/fan assembly. The suction motor is capable of providing a fluid flow force extending to the cleaning head.

The cleaning liquid supply tank 1 comprises at least one chamber for holding the cleaning liquid. In other embodiments, the cleaning liquid supply tank can comprise a plurality of chambers. In the present embodiment, the cleaning liquid is water. In other embodiments, the cleaning liquid may be other types of cleaning liquids. The cleaning liquid supply tank 1 is detachably mounted on the housing 14. The user can replenish the cleaning liquid supply tank 1 with the cleaning liquid at any time as required.

The dirty liquid recovery tank 3 is detachably mounted on a front portion of the housing 14. With such a structure, the user can conveniently empty the dirty liquid recovery tank 3 at any time as required. In other embodiments, the dirty liquid recovery tank can be mounted at other locations, even anywhere on the housing 14.

The steam generator 2 is a steam conversion component which is capable of heating the cleaning liquid from the cleaning liquid supply tank 1 to at least 100° C., and convert it into high-temperature steam output.

The cleaning head 12 comprises a housing 16 which is pivotally mounted the lower portion of the body 11 via a rotating joint 5. The rotating joint 5 enables the body 11 to rotate between the upright parked position and the backwardly reclined using position.

Figure 3:
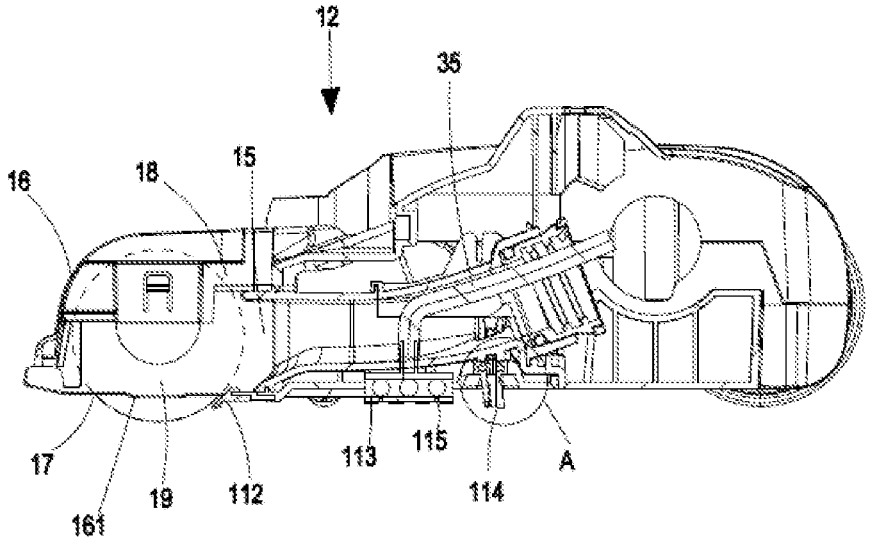
FIG. 3 is a schematic diagram of an internal structure of a cleaning head according to the first embodiment of the present invention.

FIG. 3 shows and describes an internal structure of the cleaning head 12. A roller chamber 18 with an opening 17 is defined on the housing 16, a cleaning roller 19 is positioned in the roller chamber 18 in such a way as to be able to rotate, and a driving arrangement (not shown in the figure) which drives the cleaning roller 19 to rotate is arranged inside the housing 16. In the present embodiment, the opening 17 is formed in a lower portion 161 of the housing 16, and a lower portion of the cleaning roller 19 protrudes downwards from the opening 17 to contact the surface to be cleaned. A front suction mouth 15 is arranged in the housing 16 and communicates with both the roller chamber 18 and the suction source 4.

Figure 6:
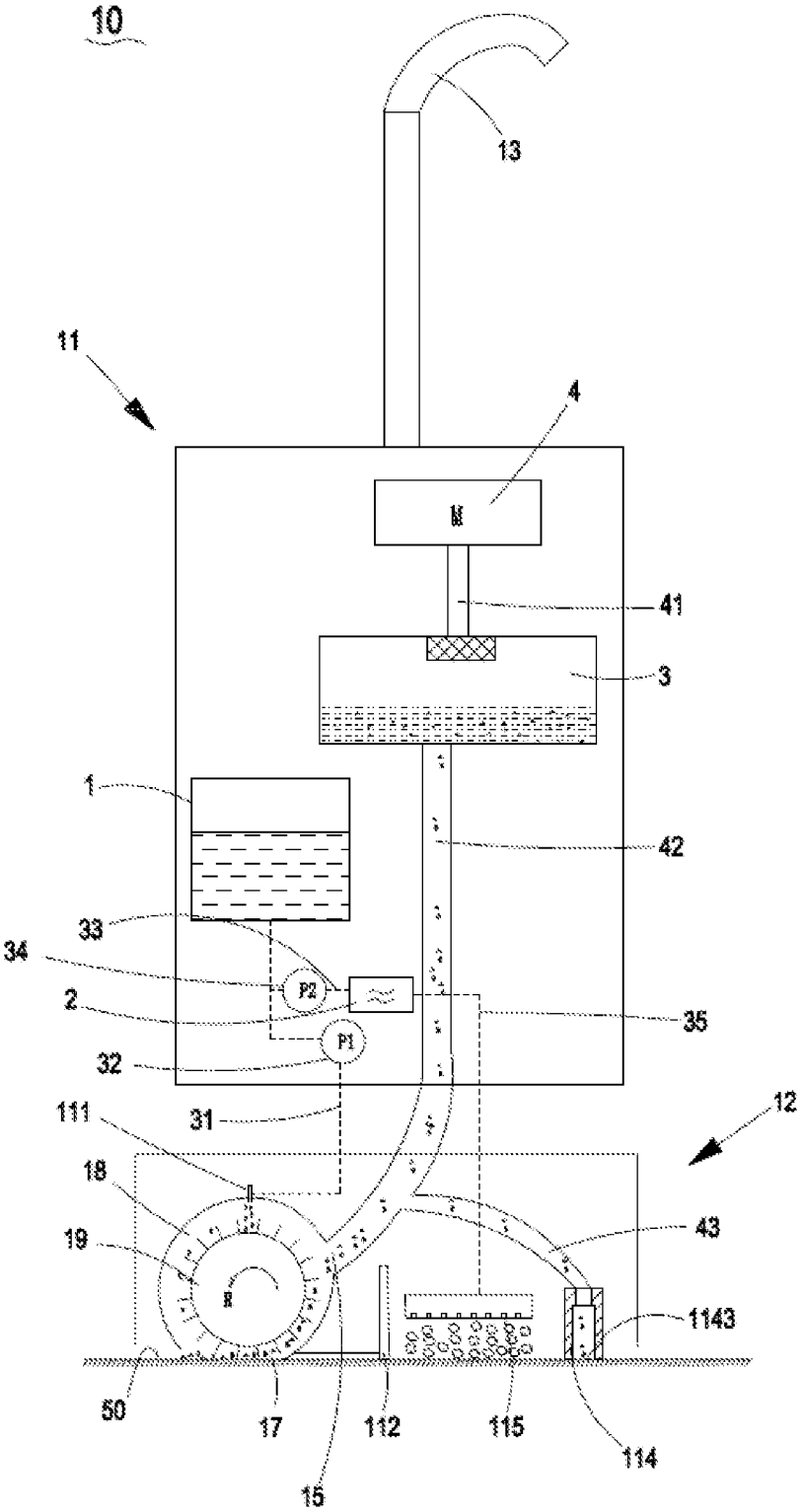
FIG. 6 is a schematic diagram of the working principle of the surface cleaning apparatus according to the first embodiment of the present invention.
Figure 7:
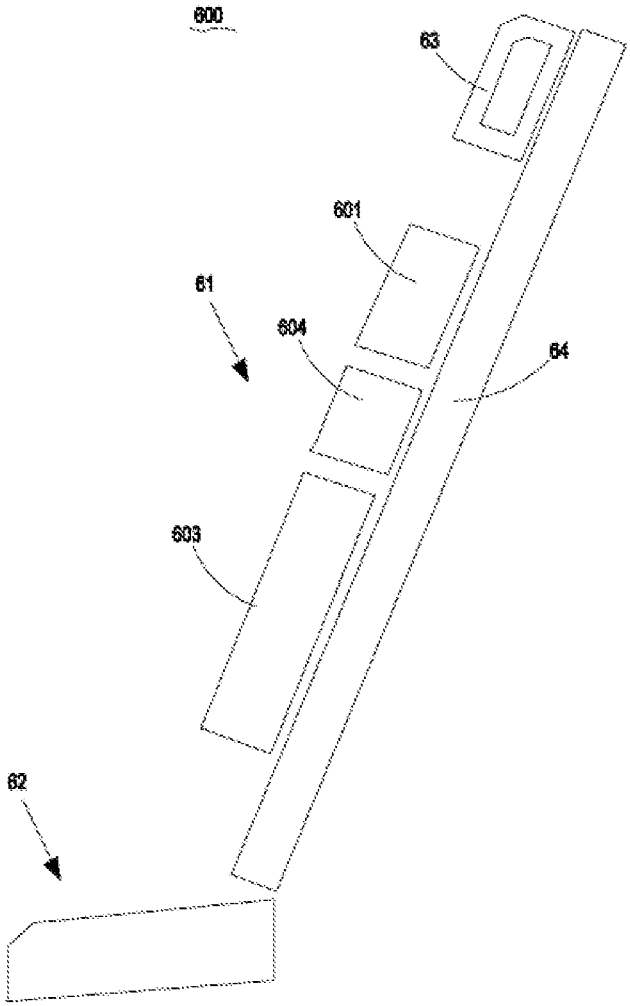
FIG. 7 is a stereogram of a surface cleaning apparatus according to a second embodiment of the present invention.

With reference to FIG. 6, the cleaning head 12 is also provided with, inside the roller chamber 18, a cleaning liquid outlet 111 located around the cleaning roller 19, and the cleaning liquid outlet 111 communicates with the cleaning liquid supply tank 1 and can deliver the cleaning liquid in the cleaning liquid supply tank 1 to the cleaning roller 19. In other embodiments, the cleaning liquid outlet may also be arranged to deliver the cleaning liquid toward the surface to be cleaned without the aid of the cleaning roller, but to directly apply the cleaning liquid directly to the surface to be cleaned or to simultaneously deliver the cleaning liquid to both the cleaning roller and the surface to be cleaned. For example, the cleaning liquid outlet may be positioned in a front side of the cleaning roller.

In the present embodiment, an outside surface of the cleaning roller 19 is covered with cleaning materials such as bristles, fabrics, or the similar, and these cleaning materials are configured to be wetted by the cleaning liquid such as water.

As shown in FIG. 3 again, the lower portion 161 of the housing 16 is further provided with a flexible partition 112, a steam bottom plate 113 and a flexible flat suction nozzle 114 from front to back in sequence at the rear side of the opening 17. The flexible flat suction nozzle 114 is located behind the steam outlet 115 and communicates with the suction source 4.

Figure 4:
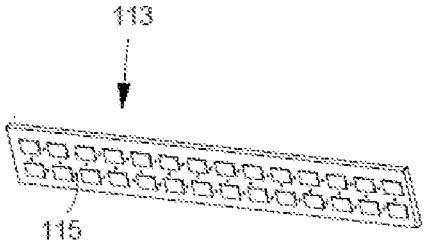
FIG. 4 is a stereogram of a steam bottom plate according to the first embodiment of the present invention.

As shown in FIG. 4, the steam bottom plate 113 plays a role of diffusing the steam so as to apply the steam to the surface to be cleaned on the lower side of the steam bottom plate 113 as evenly as possible. In the present embodiment, the steam bottom plate 113 is rectangular, and is provided with a plurality of steam outlets 115 on the lower surface thereof. In the present embodiment, the steam bottom plate 113 and the lower portion 161 of the housing 16 are provided in separate members. In other embodiments, both the steam bottom plate 113 and the lower portion 161 can also be formed in one body. The steam outlet 115 can spray high temperature steam generated by the steam generator 2 to the surface to be cleaned to heat the surface to be cleaned. In the present embodiment, the steam outlet 115 is configured to spray high-temperature steam directly to the surface to be cleaned. The outlet opening of the steam outlet 115 is not limited to being perpendicular to the surface to be cleaned and may also be inclined to a certain degree relative to the surface to be cleaned as long as the structure may overflow steam to the surface to be cleaned. In other embodiments, some cleaning components made of steam-permeable materials, such as steam-permeable cleaning cloths and brushes, may also be provided at the steam outlet. The cleaning components should be configured to ensure that the steam cannot be prevented from being delivered to the surface to be cleaned. When the cleaning head is designed, no matter the steam output from the steam outlet is directly applied to the surface to be cleaned or delivered to the surface to be cleaned after passing through the cleaning component made of the permeable material, it must be ensured that the temperature of the steam is still high enough, preferably the temperature reaches 100° C. or above, when the steam contacts with the surface to be cleaned.

As shown in FIG. 3 again, the flexible partition 112 is arranged between the opening 17 and the steam bottom plate 113 and may prevent steam from escaping from the steam outlet 115 to the opening 17.

Figure 5:
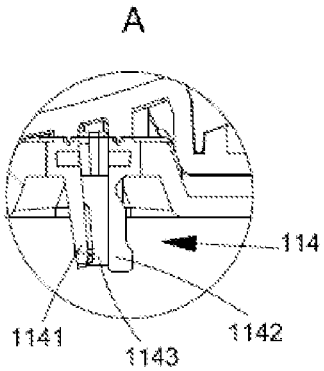
FIG. 5 is an enlarged schematic diagram of FIG. 3 at A.

As shown in FIG. 5, the flexible flat suction nozzle 114 is configured to be superior to the structure sucking the liquid and small particles. In the present embodiment, the flexible flat suction nozzle 114 comprises a front lip 1141 and a rear scraper lip 1142 which are relatively front and back to each other, and a rear suction mouth 1143 is formed between the front scraper lip 1141 and the rear scraper lip 1142. The flexible flat suction nozzle 114 can suck the liquid remaining on the surface to be cleaned. The liquid may be water droplets condensed from steam overflowing from the steam outlet 115 and remaining on the surface to be cleaned, or residual liquid not being removed from the cleaned surface after the cleaning roller passes by. Likewise, in order to prevent the rear suction mouth 1143 from directly sucking away the steam escaping from the steam outlet 115, a component similar to the aforementioned "flexible partition 112" should also be provided between the rear suction mouth 1143 and the steam outlet 115.

In other embodiments, the flexible flat suction nozzle and the rear suction mouth may also be cancelled, instead, a liquid-scraping strip capable of scraping the liquid on the flat surface is used. Under the circumstance that the flexible flat suction nozzle and the rear suction mouth are cancelled, all the liquid on the surface to be cleaned is sucked in through the front suction mouth in the front portion of the housing 16. In this case, in order to suck all the liquid on the surface to be cleaned, the cleaning head should reciprocate on the surface to be cleaned time and time again.

With reference to FIG. 6, the suction source 4 is in fluid communication with the dirty liquid recovery tank 3 through an upper suction passage 41. The dirty liquid recovery tank 3 communicates with the front suction mouth 15 in the cleaning head 3 through a lower suction passage 42. The rear suction mouth 1143 of the flexible flat suction nozzle 114 communicates with the lower suction passage 42 through a suction bypass 43. A first cleaning liquid output pipeline 31 is arranged between the cleaning liquid supply tank 1 and the cleaning liquid outlet 111, and a pump 32 is arranged on the first cleaning liquid output pipeline 31. The cleaning liquid in the cleaning liquid supply tank 1 may be directly delivered to the cleaning liquid outlet 111 by starting the pump 32. A second cleaning liquid output pipeline 33 is arranged between the cleaning liquid supply tank 1 and the steam generator 2, and a pump 34 is provided in the second cleaning liquid output pipeline 33. The cleaning liquid in the cleaning liquid supply tank 1 can be delivered to the steam generator 2 by starting the pump 34. A steam output pipeline 35 is arranged between an output end of the steam generator 2 and a steam outlet 115, and the cleaning liquid is converted into high-temperature steam in the steam generator 2 and delivered to the steam outlet 115 through the steam output pipeline 35. Due to the presence of the pumps 32 and 34, the user can freely choose to deliver the cleaning liquid and/or steam to the outside as required. As shown in FIG. 2, the pump 32 and the pump 34 of the present embodiment are both provided on the body 11. In other embodiments, a single pump and a plurality of valves can be used in combination to replace the solution of the two pumps in the present embodiment.

In this way, a portion of the cleaning liquid in the cleaning liquid supply tank 1 can be delivered downwards from the cleaning liquid supply tank 1 to the cleaning liquid outlet 111 through the first cleaning liquid output pipeline 31 and applied to the cleaning roller 19. Another portion of the cleaning liquid in the cleaning liquid supply tank 1 is delivered to the steam generator 2 through the second cleaning liquid output pipeline 33 and converted into high-temperature steam. The high-temperature steam is delivered to the steam outlet 115 through the steam output pipeline 35 and applied directly to the surface to be cleaned.

As shown in FIG. 6 again, when the surface cleaning apparatus 10 of the present embodiment works, the cleaning liquid outlet 111 continuously applies the cleaning liquid to the cleaning roller 19 as the cleaning roller 19 rotates around the direction R, and the surface to be cleaned 50 undergoes wet scrubbing during the contacting process of the cleaning roller 19 loaded with the cleaning liquid with the surface to be cleaned 50. After the surface to be cleaned 50 is scrubbed, the used cleaning fluid is contaminated by the dirt on the surface to be cleaned and becomes dirty liquid mixed with the dirt, and the dirty liquid and the solid waste on the surface to be cleaned are removed upwards from the surface to be cleaned at the opening 17 by a centrifugal force generated when the cleaning roller 19 rotates and the suction action of the suction source 4, and conveyed to the roller chamber 18, and then conveyed to the dirty liquid recovery tank 3 through the front suction mouth 15 and the lower suction passage 42 in sequence. The dirty liquid and solid waste will be trapped in the dirty liquid recovery tank 3, and the clean air will flow from the upper suction passage 41 to the suction source 4 and finally escape to the outside. As the cleaning head 12 is pushed to move forwards, the surface 50 subjected to wet cleaning by the cleaning roller 19 will be heated by the steam overflowing from the steam outlet 115. As the temperature of the steam is high, the steam not only heats the surface but also sterilizes the surface with high temperature after being applied to the surface. If there is residual liquid on the surface before the surface is heated by the steam, the residual liquid will be evaporated quickly as the temperature of the surface rises. If there is still residual liquid (or water droplets condensed by steam) on the surface heated by steam, then the residual liquid will be sucked up when the flexible flat suction nozzle 114 passes here and conveyed through the suction bypass 43 to the lower suction passage 42.

After the surface cleaning apparatus in the aforementioned embodiment performs cleaning, the cleaned surface is almost free of the residual liquid. If the surface is the floor, the user may directly walk on the area without waiting. If the surface is a table top, the user may directly place or stack articles on the surface. As high-temperature steam is also used to sterilize the surface to be cleaned while the surface is heated, the surface cleaning apparatus cleans the surface more thoroughly and has a better cleaning effect. Experimental tests show that the higher the temperature of the steam applied to the surface to be cleaned is, the faster the residual liquid on the surface will evaporate. For example, when the temperature of the steam applied to the surface reaches 90 degrees or higher, the surface of a general wood or ceramic tile may be quickly dried in 2 minutes. If the amount of cleaning liquid applied is controlled and components such as flexible flat nozzles or flexible liquid-scraping strips are used, some surfaces are expected to be dried immediately within 5 seconds after being cleaned.

In other embodiments, the steam outlet may also be arranged in other positions of the housing, such as the front side or the left and right sides thereof. For example, when the steam outlet is arranged on the front side of the housing, the steam outlet on the front side may soften the dirt on the surface with the steam in advance and at the same time heat the surface, which provides convenience for the subsequent cleaning by the cleaning roller. The heated surface is also more conducive to the evaporation of the residual liquid on the surface after the surface is cleaned by the cleaning roller. In addition, in other embodiments, steam outlets may also be arranged at a plurality of positions including the front side, the rear side, and the left and right sides to meet the requirements of steam application. In addition, the surface cleaning apparatus may also be designed to adopt a horizontal structure or other portable structures, and all the structures including the solution of the present invention fall within the protection scope of the present invention.

The surface cleaning apparatus similar to the wet surface cleaning apparatus is described in the aforementioned embodiment, and the surface cleaning apparatus may integrate the functions of dust collection, wet cleaning with cleaning liquid and steam sterilization. In particular, steam is introduced, which not only implements sterilization but also helps the liquid which remains when the cleaning roller performs cleaning evaporate quickly by increasing the temperature of the surface to be cleaned, thereby shortening the time for the user to wait for the floor to dry when this type of wet surface cleaning apparatus is used and improving the user experience.

FIGS. 7-10 show schematic diagrams of a surface cleaning apparatus 600 in a second embodiment of the present invention, and the apparatus 600 is also a vertical cleaning apparatus which may suck dirt on a surface to be cleaned and perform operations such as wet scrubbing with a cleaning liquid and steam heating. The surface cleaning apparatus 600 includes a body 61 and a cleaning head 62. A lower portion of the body 61 is in articulately connection to the cleaning head 62, and the body 61 can rotate between an upright parked position and a backwardly reclined using position relative to the cleaning head 62. During the cleaning process of the surface cleaning apparatus 600 along the surface to be cleaned, the cleaning head 62 is supported on the surface to be cleaned and driven by the body 61 to move along the surface to be cleaned.

The surface cleaning apparatus 600 is provided with a cleaning liquid supply unit, a steam supply unit, and a dirty liquid recovery unit. The cleaning liquid supply unit is used to store the cleaning liquid and deliver the cleaning liquid to the surface to be cleaned, and the cleaning liquid supply unit includes a cleaning liquid supply tank 601 which is used to store the cleaning liquid. The steam supply unit is used to heat and convert the cleaning liquid into high-temperature steam by a steam generator 602 (see FIG. 10) and apply the steam to the surface to be cleaned. The dirty liquid recovery unit is used to remove the dirty liquid converted by the used cleaning liquid and the solid waste on the surface to be cleaned from the surface, and store the dirty liquid and solid waste for a certain period of time. The dirty liquid recovery unit includes a dirty liquid recovery tank 603 and a suction source 604 for storing the dirty liquid and solid waste for a certain period of time.

The body 61 in the present embodiment is similar in structure to the body 11 in the embodiment shown in FIGS. 1-6. The suction source 604, a handle 63, the cleaning liquid supply tank 601, the steam generator 602, the dirty liquid recovery tank 603 and the like are also similar in structure to those in the embodiment shown in FIGS. 1-6, and these components are also carried on a housing 64 of the body 61, which will not be repeated herein. The cleaning head 62 includes a housing 66 (see FIGS. 8 and 9), and the housing 66 is in articulately connection with the lower portion of the body 61.

Figure 8:
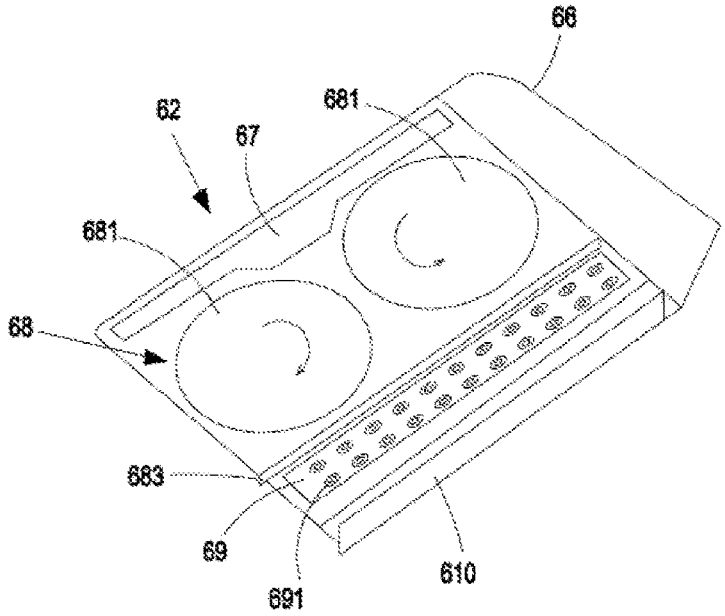
FIG. 8 is a schematic diagram of a bottom structure of a cleaning head according to the second embodiment of the present invention.

As shown in FIG. 8 which shows and describes the bottom structure of the cleaning head 62 in the present embodiment. A scrubbing mechanism 68 includes a pair of cleaning trays 681 which are distributed horizontally and capable of rotating about an axis substantially perpendicular to the surface to be cleaned. A suction nozzle 67, the pair of cleaning trays 681, a steam bottom plate 69, and a flexible scraping strip 610 are sequentially arranged at the bottom of the housing 66 from front to back. The steam bottom plate 69 is provided with a number of steam outlets 691 from which steam overflows towards the surface to be cleaned. The cleaning liquid in the cleaning liquid supply tank 601 is delivered to the steam heater 602 by the action of a pump 605 (see FIG. 10), and heated and converted into steam, and then the steam overflows from the steam outlet 691.

Figure 9:
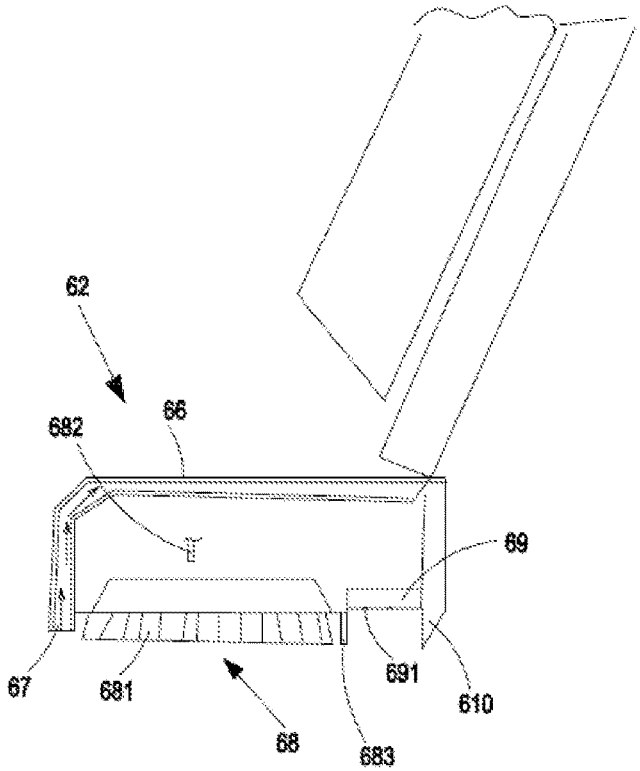
FIG. 9 is a schematic diagram showing a positional relationship of components in the cleaning head according to the second embodiment of the present invention.
Figure 10:
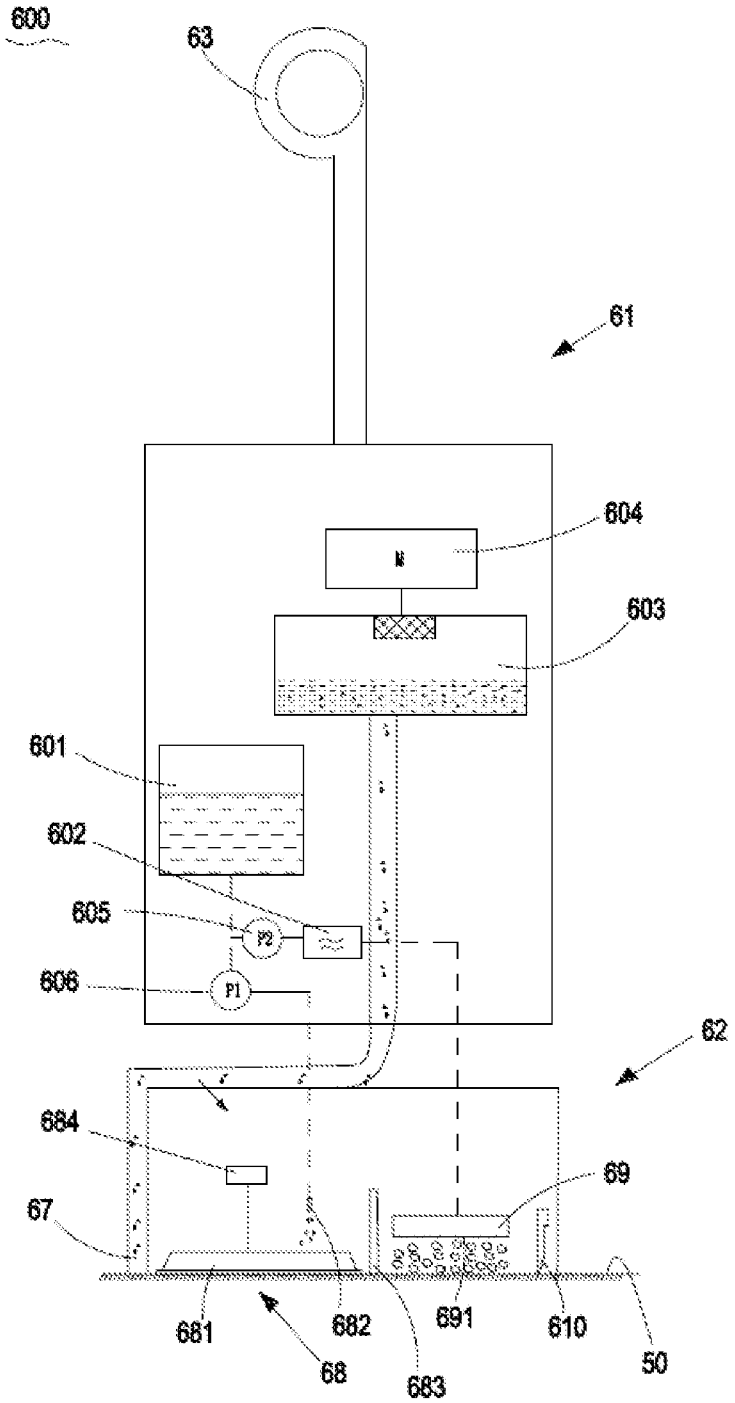
FIG. 10 is a schematic diagram of the working principle of the surface cleaning apparatus according to the second embodiment of the present invention.

As shown in FIGS. 9-10, the suction nozzle 67 extends towards the surface to be cleaned. The suction nozzle 67 communicates with the dirty liquid recovery tank 603, and the suction source 604 is in fluid communication with the dirty liquid recovery tank 603. Under the action of the suction source 604, the suction source 604 may generate working airflow which passes through the suction nozzle 67 and enters the dirty liquid recovery tank 603, that is, while the cleaning head 62 is moving along the surface to be cleaned, the suction nozzle 67 can suck up the dirty liquid and waste in small particles on the surface to be cleaned and move them to the dirty liquid recovery tank 603 together with the working airflow. A cleaning liquid outlet 682 for applying the cleaning liquid to the pair of cleaning trays 681 is arranged on the upper side of the pair of cleaning trays 681, and the cleaning liquid outlet 682 is in fluid communication with the cleaning liquid supply tank 601. A pump 606 is provided between the cleaning liquid outlet 682 and the cleaning liquid supply tank 601. Under the action of the pump 606, the cleaning liquid is continuously delivered from the cleaning liquid supply tank 601 to the cleaning liquid outlet 682.

The scrubbing mechanism 68 further includes a driving motor 684 for driving the pair of cleaning trays 681 to rotate. In the present embodiment, the driving motor 684 drives the pair of cleaning trays 681 to rotate at the same time. In other embodiments, a pair of motors may also be used to drive a pair of cleaning trays to rotate respectively. The rotating directions of the pair of cleaning trays 681 in the present embodiment are always opposite. A flexible partition 683 is provided between the scrubbing mechanism 68 and the steam bottom plate 69, and the flexible partition 683 can effectively prevent the steam overflowing from the steam outlet 691 from surging forward.

The steam bottom plate 69 in the present embodiment is the same as that in the aforementioned embodiment shown in FIGS. 1-6, and can play a role of diffusing the steam, so as to apply the high-temperature steam generated by the steam generator to the surface to be cleaned through the steam outlet 691 for heating the surface to be cleaned.

As shown in FIG. 10, when the surface cleaning apparatus 600 of the present embodiment works, the cleaning head 62 reciprocates forwards and backwards on the surface to be cleaned 50, and the suction nozzle 67 continuously sucks the dirty liquid and small solid particle waste on the surface to be cleaned into the cleaning head 62 and then conveys them into the dirty liquid recovery tank 603; the cleaning liquid outlet 682 continuously applies the cleaning liquid to the pair of cleaning trays 681, and the pair of cleaning trays 681 wetted by the cleaning liquid scrubs the surface 50 to be cleaned during the process of rubbing against the surface to be cleaned 50; and after the surface 50 to be cleaned is scrubbed, the surface 50 scrubbed by the pair of cleaning trays 681 will be heated by the steam overflowing from the steam outlet 691. As the temperature of the steam is high, the steam not only heats the surface but also sterilizes the surface with high temperature after the steam is applied to the surface. If there is residual cleaning liquid on the surface before the surface is heated by steam, the residual cleaning liquid will evaporate rapidly with the increase in temperature of the surface. If there is still residual liquid (or water droplets condensed by steam) on the surface heated by the steam, then the residual liquid will be scraped when the flexible scraping strip 610 passes here and sucked up and conveyed to the dirty liquid recovery tank 603 when the suction nozzle 67 moves here next time.

Figure 11:
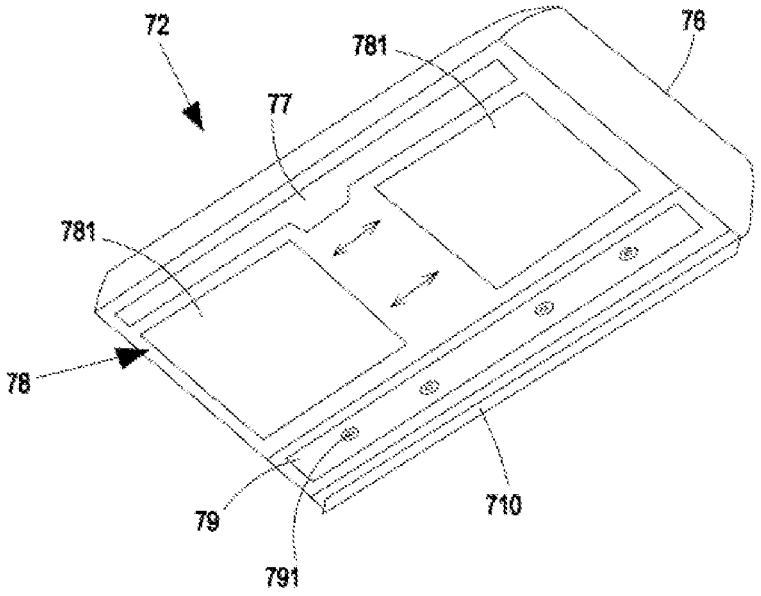
FIG. 11 is a schematic diagram of a bottom structure of a cleaning head according to a third embodiment of the present invention.

FIG. 11 shows a schematic diagram of a bottom of a cleaning head 72 according to a third embodiment of the present invention. The main difference between the cleaning head 72 and the cleaning head in the embodiment in FIG. 8 lies in structure and principle of the scrubbing mechanism. The scrubbing mechanism 78 in the cleaning head 72 of the present embodiment includes a pair of cleaning pads 781 which are capable of reciprocating forwards and backwards under the drive of a driving motor (not shown in the figure), and the reciprocating directions of the pair of cleaning pads 781 are always opposite. In other embodiments, the pair of cleaning pads may also reciprocate forwards and backwards.

Figure 12:
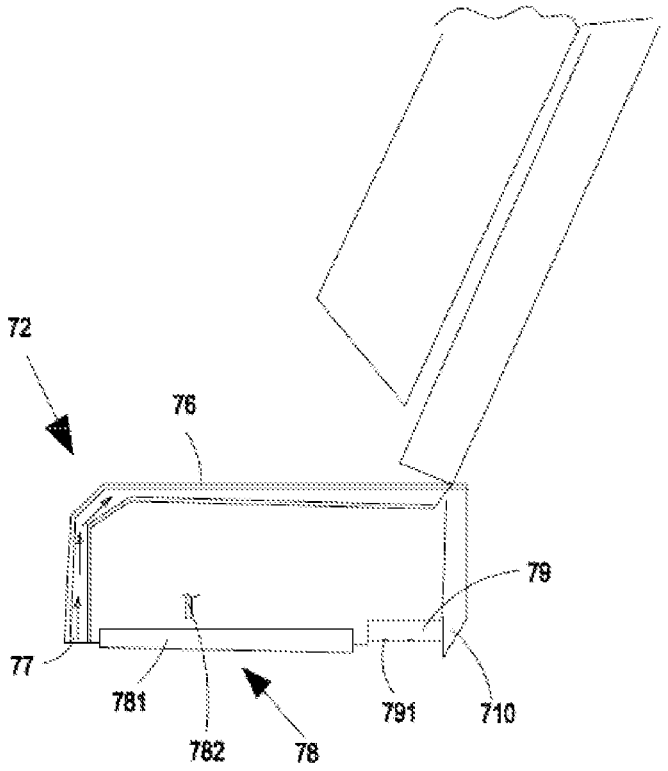
FIG. 12 is a schematic diagram showing a positional relationship of components in the cleaning head according to the third embodiment of the present invention.

As shown in FIG. 12, an upper side of the cleaning pad 781 is also provided with a cleaning liquid outlet 782 for applying a cleaning liquid to the pair of cleaning pads 781, and the cleaning liquid outlet 782 is in fluid communication with a cleaning liquid supply tank (not shown in the figure). During the reciprocating movement of the cleaning pad 781, the surface to be cleaned can be subjected to wet scrubbing. In addition to the scrubbing mechanism 78, a suction nozzle 77, a steam bottom plate 79 and a flexible scraping strip 710 are also arranged at the bottom of a housing 76. The suction nozzle 77, the pair of cleaning pads 781, the steam bottom plate 79 and the flexible scraping strip 710 are arranged in sequence from front to back. The steam bottom plate 79 is provided with steam outlets 791 from which steam overflows towards the surface to be cleaned.

When the cleaning head 72 works, the suction nozzle 77 continuously sucks the dirty liquid and small solid particle waste on the surface to be cleaned into the cleaning head 72 and conveys them into the dirty liquid recovery tank; the cleaning liquid outlet 782 continuously applies the cleaning liquid to the pair of cleaning pads 781, and the pair of cleaning pads 781 wetted by the cleaning liquid scrubs the surface to be cleaned during the process of rubbing against the surface to be cleaned; and after the surface to be cleaned is scrubbed, the surface scrubbed by the pair of cleaning pads 781 will be heated by the steam overflowing from the steam outlet 791. As the temperature of the steam is high, the steam not only heats the surface but also sterilizes the surface with high temperature after it is applied to the surface. If there is residual cleaning liquid on the surface before the surface is heated by steam, the residual cleaning liquid will evaporate rapidly with the increase in temperature of the surface. If there is still residual liquid (or water droplets condensed by steam) on the surface heated by steam, then the residual liquid will be scraped when the flexible scraping strip 710 passes here and sucked up and conveyed to the dirty liquid recovery tank when the suction nozzle 77 moves here next time.

Figure 13:
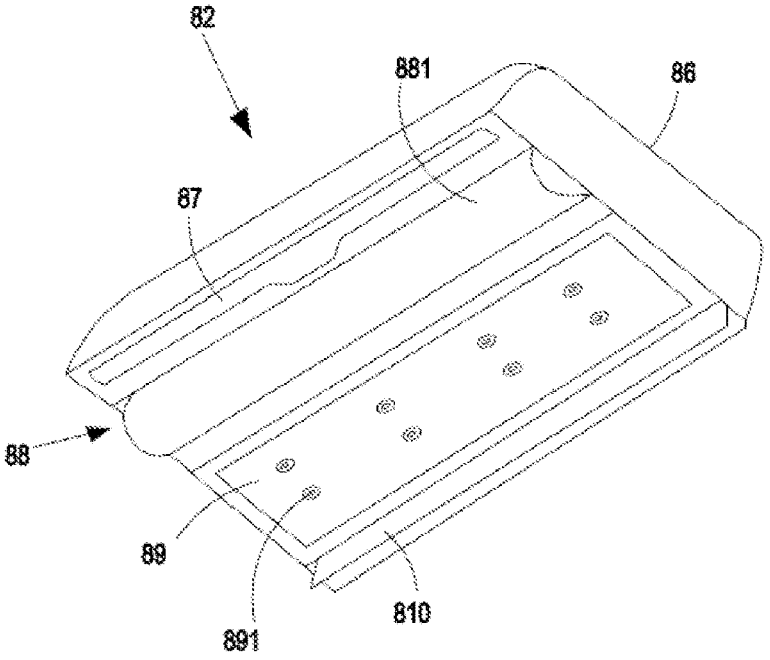
FIG. 13 is a schematic diagram of a bottom structure of a cleaning head according to a fourth embodiment of the present invention.

FIG. 13 shows a schematic diagram of a bottom of a cleaning head 82 according to a fourth embodiment of the present invention. The structure and principle of the scrubbing mechanism 88 of the cleaning head 82 are different from those of the scrubbing mechanism of the cleaning head in the embodiment in FIG. 8. The scrubbing mechanism 88 in the cleaning head 82 of the present embodiment is a brushroll 881 which can rotate about a horizontal axis under the driving of a driving motor (not shown in the figure), and a lower portion of the brushroll 881 rubs against the surface to be cleaned during the rotating process.

Figure 14:
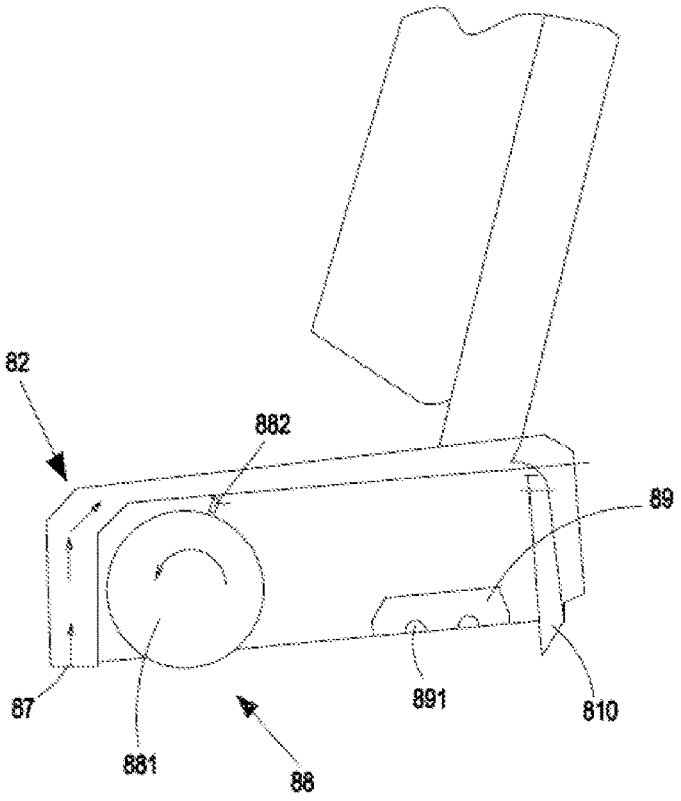
FIG. 14 is a schematic diagram showing a positional relationship of components in the cleaning head according to the fourth embodiment of the present invention.

As shown in FIG. 14, a cleaning liquid outlet 882 for spraying cleaning liquid to the brushroll 881 is also provided above the brushroll 881, and the cleaning liquid outlet 882 is in fluid communication with a cleaning liquid supply tank. During the rotating process, the brushroll 881 can perform wet scrubbing on the surface to be cleaned. In addition to the scrubbing mechanism 88, a suction nozzle 87, a steam bottom plate 89 and a flexible scraping strip 810 are also arranged at the bottom of the housing 86; and the suction nozzle 87, the brushroll 881, the steam bottom plate 89 and the flexible scraping strip 810 are arranged from front to back in a successive manner. The steam bottom plate 89 is provided with steam outlets 891 from which steam overflows towards the surface to be cleaned.

When the cleaning head 82 works, the suction nozzle 87 continuously sucks the dirty liquid and small solid particle waste on the surface to be cleaned into the cleaning head 82 and conveys them into the dirty liquid recovery tank; the cleaning liquid outlet 882 continuously applies the cleaning liquid to the brushroll 881, and brushroll 881 wetted by the cleaning liquid scrubs the surface to be cleaned during the process of rubbing against the surface to be cleaned; and after the surface to be cleaned is scrubbed, the surface scrubbed by the brushroll 881 will be heated by the steam overflowing from the steam outlet 891. As the temperature of the steam is high, the steam not only heats the surface but also sterilizes the surface with high temperature after it is applied to the surface. If there is residual cleaning liquid on the surface before the surface is heated by steam, the residual cleaning liquid will evaporate rapidly with the increase in temperature of the surface. If there is still residual liquid (or water droplets condensed by steam) on the surface heated by steam, then the residual liquid will be scraped when the flexible scraping strip 810 passes here and sucked up and conveyed to the dirty liquid recovery tank when the suction nozzle 87 moves here next time.

The surface cleaning apparatuses in the second, third, and fourth embodiments described above are apparatuses that integrate the functions of vacuum collection, wet scrubbing, steam sterilization, and quick drying. During the wet scrubbing process performed by the scrubbing arrangement, these apparatuses heat the surface with the steam and thus sterilize the surface with high temperature. The increase in the temperature of the surface to be cleaned is conducive to the rapid evaporation of the liquid which remains on the surface when a floor scrubbing apparatus is used to scrub the floor, which shortens the time for the user to wait for the floor to dry when this type of surface wet scrubbing machine is used and improves the user experience. Furthermore, the scrubbing apparatus of the present invention is not limited to the above structural solutions, and any scrubbing apparatus which can perform wet scrubbing on the surface to be cleaned falls within the scope of the present invention. The cleaning fluid outlet may also directly apply the cleaning fluid to the floor to be cleaned, and the location of the steam outlet is not limited to this, and any location where the steam outlet may apply the steam to the surface to be cleaned to increase the temperature on the surface may be adopted as the location of the steam outlet in the present invention.

The solution of the present invention may also be used in other types of wet extraction cleaning apparatuses that may use the cleaning liquid to scrub or clean the surface to be cleaned. The cleaning liquid may be conveyed to the surface to be cleaned directly or via the cleaning roller or the cleaning component on the floor scrubbing apparatus, and the used cleaning liquid and the solid waste originally existing on the surface to be cleaned will be sucked together into the machine. When the steam overflows to the surface to be cleaned, it can, in one aspect, sterilize the surface to be cleaned, and, in the other aspect, also heat the surface so as to accelerate the evaporation of the residual liquid that is not sucked up from the surface.

The aforementioned embodiments are only intended to illustrate the technical concept and features of the present invention, and the objective thereof is to enable those skilled in the art to understand the content of the present invention and implement it accordingly, and they should not limit the protection scope of the present invention. All equivalent changes or modifications made according to the spirit of the present invention should be covered within the protection scope of the present invention.

What is claimed is:

1. A surface cleaning apparatus, comprising:

a cleaning head adapted to move along a surface to be cleaned including a housing and a scrubbing arrangement, the scrubbing arrangement including a scrubbing mechanism arranged on the housing for scrubbing the surface by rubbing against the surface to be cleaned, and at least one driving motor connected to the scrubbing mechanism for driving the scrubbing mechanism to perform a scrubbing action;

a cleaning liquid supply tank adapted to store a cleaning liquid;

a steam generator in fluid communication with the cleaning liquid supply tank configured to heat liquid to generate steam;

a first fluid delivery unit comprising at least one cleaning liquid outlet for applying the cleaning liquid in the cleaning liquid supply tank to the scrubbing mechanism and/or the surface to be cleaned;

a second fluid delivery unit comprising at least one steam outlet for applying the steam generated by the steam generator to the surface to be cleaned; and a dirty liquid recovery system used to remove the used cleaning liquid and dirt from the surface to be cleaned and store the used cleaning liquid and dirt, the dirty liquid recovery system comprising a dirty liquid recovery tank used to store dirty liquid and dirt;

wherein the at least one steam outlet is arranged at a lower portion of the housing and configured to work simultaneously with at least one fluid outlet so as to heat the surface by overflowing steam to the surface during the process of cleaning the surface with the cleaning liquid to accelerate the evaporation of residual cleaning liquid on the surface.

2. The surface cleaning apparatus of claim 1, wherein the dirty liquid recovery system further comprises a suction source and at least one suction nozzle provided on the cleaning head, and wherein the suction source is in fluid communication with the dirty liquid recovery tank and configured to generate working airflow through the at least one suction nozzle and into the dirty liquid recovery tank.

3. The surface cleaning apparatus of claim 2, wherein the at least one suction nozzle is arranged at a front end of the housing and configured to extend toward the surface to be cleaned, and the scrubbing mechanism is positioned behind the suction nozzle which is located at the front end of the housing.

4. The surface cleaning apparatus of claim 1, wherein the scrubbing mechanism comprises at least one brushroll configured to rotate about an axis substantially parallel to the surface to be cleaned.

5. The surface cleaning apparatus of claim 1, wherein the scrubbing mechanism comprises at least one cleaning tray mounted at the lower portion of the housing and configured to rotate about an axis substantially perpendicular to the surface to be cleaned.

6. The surface cleaning apparatus of claim 1, wherein the scrubbing mechanism comprises a pair of cleaning pads mounted at the lower portion of the housing and configured to reciprocally move in a front-rear direction or a left-right direction, and wherein the moving directions of the pair of cleaning pads are always opposite.

7. The surface cleaning apparatus of claim 1, wherein at least a portion of the at least one steam outlet is positioned behind the scrubbing mechanism such that the surface cleaning apparatus is capable of heating a surface scrubbed by the scrubbing mechanism with the steam overflowing from the steam outlet.

8. A surface cleaning apparatus, comprising:

a cleaning head adapted to move along a surface to be cleaned and including a housing and a cleaning arrangement to contact the surface to be cleaned;

a cleaning liquid supply tank adapted to store cleaning liquid;

a steam generator in fluid communication with the supply tank and configured to heat liquid to generate steam;

a first fluid delivery unit comprising at least one cleaning liquid outlet for applying the cleaning liquid in the cleaning liquid supply tank to the cleaning arrangement and/or the surface to be cleaned;

a second fluid delivery unit comprising at least one steam outlet for applying the steam generated by the steam generator to the surface to be cleaned; and a dirty liquid recovery tank configured to accept dirty liquid and dirt;

wherein the at least one steam outlet is arranged at a lower portion of the housing and configured to selectively work simultaneously with the at least one cleaning liquid outlet during the process of cleaning the surface with the cleaning liquid.

9. The surface cleaning apparatus of claim 8, wherein the cleaning arrangement includes a scrubbing mechanism arranged on the housing for scrubbing the surface by rubbing against the surface to be cleaned, and wherein at least one driving motor is connected to the scrubbing mechanism for driving the scrubbing mechanism to perform a scrubbing action.

10. The surface cleaning apparatus of claim 8, wherein the cleaning head further includes a cleaning cloth or a brush for scrubbing the surface to be cleaned provided at the lower portion of the housing, wherein the steam outlet is configured to spray the steam to the cleaning cloth or the brush, and the cleaning cloth is made of a steam-permeable material.

11. The surface cleaning apparatus of claim 8, wherein the cleaning arrangement comprises a cleaning roller rotatably arranged in a roller chamber having an opening in the lower portion of the housing, and wherein at least a portion of the cleaning roller is extending through the opening.

12. The surface cleaning apparatus of claim 11, and further comprising a suction source, wherein the housing is provided with a front suction mouth in fluid communication with the roller chamber and the suction source, and wherein the dirty liquid recovery tank is in fluid communication with the front suction mouth.

13. The surface cleaning apparatus of claim 12, wherein at least a part of the at least one steam outlet is positioned behind the opening to enable the surface cleaning apparatus to heat a surface cleaned by the cleaning roller with the steam overflowing from the at least one steam outlet.

14. The surface cleaning apparatus of claim 13, wherein the cleaning head further includes a flexible partition arranged between the at least one steam outlet and the opening.

15. The surface cleaning apparatus of claim 12, wherein the cleaning head further includes a rear suction mouth provided at a rear portion of the housing and a flexible flat suction nozzle arranged at the lower portion of the housing, wherein the rear suction mouth is positioned behind the at least one steam outlet and configured to be in fluid communication with the suction source, and wherein the flexible flat suction nozzle comprises a pair of flexible scraper lips arranged relatively front and back to each other, the rear suction mouth is formed at the flexible flat suction nozzle, and at least one of the flexible scraper lips interferes with the surface to be cleaned when the cleaning head moves along the surface.

16. The surface cleaning apparatus of claim 15, wherein the cleaning head further includes a flexible liquid-scraping strip positioned behind the steam outlet, and wherein the strip interferes with the surface to be cleaned when the cleaning head moves along the surface to be cleaned.

17. The surface cleaning apparatus of claim 11, wherein the at least one steam outlet is arranged on the front side or left and right sides of the opening.

18. The surface cleaning apparatus of claim 8, wherein the first fluid delivery unit and the second fluid delivery unit are each configured to be independently controllable for a user selectable delivery of the cleaning liquid or steam.

19. The surface cleaning apparatus of claim 8, wherein the cleaning head further includes a steam diffuser provided at the lower portion of the housing for diffusing the steam generated by the steam generator, and wherein the at least one steam outlet is located at a lower portion of the steam diffuser.

20. The surface cleaning apparatus of claim 8, and further comprising a body having a handle at an upper part, wherein the cleaning head is in articulate connection to a lower part of the body, and wherein the dirty liquid recovery tank and the cleaning liquid supply tank are both detachably positioned on the body.

* * * * *